US009414728B2

(12) United States Patent
Van Der Kooi et al.

(10) Patent No.: US 9,414,728 B2
(45) Date of Patent: Aug. 16, 2016

(54) CLEANING DEVICE FOR CLEANING A SURFACE

(71) Applicant: KONINKLIJKE PHILIPS N.V., Eindhoven (NL)

(72) Inventors: Johannes Tseard Van Der Kooi, Eindhoven (NL); Britt Roumen, Eindhoven (NL); Matthijs Hendrikus Lubbers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/654,045

(22) PCT Filed: Dec. 13, 2013

(86) PCT No.: PCT/EP2013/076510

§ 371 (c)(1),
(2) Date: Jun. 19, 2015

(87) PCT Pub. No.: WO2014/095614

PCT Pub. Date: Jun. 26, 2014

(65) Prior Publication Data

US 2015/0297047 A1 Oct. 22, 2015

(30) Foreign Application Priority Data

Dec. 20, 2012 (EP) ..... 12198327

(51) Int. Cl.
*A47L 13/11* (2006.01)
*A47L 7/00* (2006.01)
(Continued)

(52) U.S. Cl.
CPC ..... *A47L 7/0009* (2013.01); *A47L 7/0042* (2013.01); *A47L 9/0411* (2013.01); *A47L 9/0477* (2013.01);
(Continued)

(58) Field of Classification Search
CPC ..... A47L 7/009; A47L 7/0042; A47L 9/0477; A47L 11/282; A47L 11/4041; A47L 11/4044
USPC ..... 15/401
IPC ..... A47L 13/11
See application file for complete search history.

(56) References Cited

U.S. PATENT DOCUMENTS 1,209,384 A 12/1916 Blaney
4,234,995 A * 11/1980 Parise ..... A47L 9/0411 15/322
4,310,944 A 1/1982 Kroll

FOREIGN PATENT DOCUMENTS

AU 2960889 A 8/1989
WO 2009074930 A1 6/2009
WO 2010041184 A1 4/2010
WO WO2015/074769 * 5/2015

* cited by examiner

*Primary Examiner* — David Redding

(57) ABSTRACT

The present invention relates to a nozzle arrangement (10) for a cleaning device (100) for cleaning a surface, the nozzle arrangement comprising: —a brush (12) rotatable about a brush axis (14), the brush being provided with flexible brush elements (16) having tip portions (18) for contacting the surface to be cleaned (20) and picking up dirt and/or liquid particles (22, 24) from the surface (20) during the rotation of the brush (12), wherein the brush (12) is at least partly surrounded by a nozzle housing (28) and protrudes at least partly from a bottom side (30) of the nozzle housing (28), —a squeegee element (32) which is spaced apart from the brush (12) and attached to the bottom side (30) of the nozzle housing (28) on a first side (31) of the brush (12) where the brush elements (16) enter the nozzle housing (28) during the rotation of the brush (12), wherein the squeegee element (32) is configured for wiping dirt and/or liquid particles (22, 24) across or off the surface to be cleaned (20) during a movement of the cleaning device (100) —a deflector (150) for contacting the brush (12) and deflecting the brush elements (16) during the rotation of the brush (12), and —a restriction element (27) for at least partly restricting air from getting sucked into the nozzle housing (28) at a second side (29) of the brush (12) where the brush elements (16) leave the nozzle housing (28), wherein the restriction element (27) is, seen in a rotation direction (26) of the brush (12), arranged behind the deflector (25), such that the brush elements (16), during the rotation of the brush (12), contact the deflector (25) before passing the restriction element (27) and then leaving the nozzle housing (28) at the bottom side (30), and the restriction element (27) comprises a mechanically flexible element that is, due to its flexibility, configured to follow an outer surface of the brush (12) and to contact the tip portions (18) during the rotation of the brush (12).

13 Claims, 6 Drawing Sheets

(51) Int. Cl.

| | |
|---|---|
| ***A47L 11/282*** | (2006.01) |
| ***A47L 11/292*** | (2006.01) |
| ***A47L 11/40*** | (2006.01) |
| ***A47L 9/04*** | (2006.01) |
| *A46B 13/00* | (2006.01) |

(52) U.S. Cl.

CPC ..... *A47L 9/0488* (2013.01); *A47L 11/282* (2013.01); *A47L 11/292* (2013.01); *A47L 11/4041* (2013.01); *A47L 11/4044* (2013.01); *A47L 11/4077* (2013.01); *A46B 13/001* (2013.01)

CLEANING DEVICE FOR CLEANING A SURFACE

This application is the U.S. National Phase application under 35 U.S.C. §371 of International Application No. PCT/EP2013/076510, filed on Dec. 13, 2013, which claims the benefit of International Application No. 12198327.4 filed on Dec. 20, 2012. These applications are hereby incorporated by reference herein.

FIELD OF THE INVENTION

The present invention relates to a cleaning device for cleaning a surface, and in particular to a nozzle arrangement for such a cleaning device.

BACKGROUND OF THE INVENTION

Hard floor cleaning these days is done by first vacuuming the floor, followed by mopping it. Vacuuming removes the coarse dirt, while mopping removes the stains. From the state of the art many appliances, especially targeting the professional cleaning sector, are known that claim to vacuum and mop in one go. Appliances for the professional cleaning sector are usually specialized for big areas and perfectly flat floors. They rely on hard brushes and suction power to get water and dirt from the floor. Appliances for home use often use a combination of a hard brush and a double-squeegee nozzle. Like the appliances for the professional sector these products use the brush to remove stains and the squeegees in combination with an under-pressure to lift the dirt from the floor.

The squeegee elements are usually realized by a flexible rubber lip that is attached to the bottom of the cleaning device and merely glides over the surface to be cleaned, thereby pushing or wiping dirt particles and liquid across or off the surface to be cleaned. An under-pressure, usually generated by a vacuum aggregate, is used to ingest the collected dirt particles and liquid.

Many of the known prior art vacuum cleaners use an agitator (also denoted as adjutator) with stiff brush hairs to agitate the floor. These stiff hairs show a rather good scrubbing effect, which enable to use the brush particularly for removing stains. However, the performance on drying the floor is rather low, since such an agitator is not able to lift liquid from the floor. The object of vacuuming and mopping the floor with actively sprayed water all in one go is therefore not solved with these devices in a sufficiently satisfactory manner.

WO 2010/041184 A1, which has been filed in the name of the applicant, shows an alternative cleaning device which is able to pick up dirt and liquid from the floor in one go. The cleaning device disclosed therein makes use of two separate brushes that are aligned in parallel to each other. These brushes rotate at high speeds, one running clockwise and the other one counterclockwise. In this way, the adjacent peripheries travelling together with a sufficiently high velocity to project the dirt and/or liquid particles vertically upwards with a considerable force in the form of a substantially flat jet. In contrast to the prior art devices named before, the two brushes used therein are not realized as agitators, but are equipped with flexible soft bristles.

It has been identified that such two rotating brushes generate an unwanted turbulent air blow outside the nozzle housing, which occurs as a result of the fact that the soft brushes are deflected/indented by the surface to be cleaned. The brushes thereby act as a kind of gear pump which pumps air from the inside of the nozzle housing to the outside. This blowing effect can cause dirt and/or liquid particles to be blown away from the brushes, such that they are out of reach from the brushes and could then not be ingested by the vacuum cleaner.

WO 2010/041184 A1 has found a solution to account for this unwanted blowing effect. Therein, two deflectors are used, one for each brush. These deflectors deflect/indent the bristles of the brush at a position, seen in rotation direction, before the bristles of the brush contact the surface to be cleaned. These deflectors have the function to press the bristles of the brush together by deflecting them. In this way air, which is present in the space between the bristles, is pushed out of the space. When the bristles are, after leaving the deflectors, moved apart from each other again, the space in between the bristles increases so that air will be sucked into brush, wherein an under-pressure is created that sucks in the dirt and/or liquid particles. This under-pressure compensates for the air flow that is generated by the rotating brushes.

U.S. Pat. No. 1,209,384 A discloses a street sweeping machine comprising a single rotary brush and an up-curved sheet metal hood that is mounted over the upper forward portion of the brush in order to facilitate gathering of the dirt by the brush and to control the discharge therefrom.

U.S. Pat. No. 4,310,944 A discloses a powered sweeping machine, particularly suitable for efficiently removing light and heavy weight litter from surfaces such as parking lots, warehouse floors and the like. The machine includes a main frame carrying a hopper and a powered brush. The brush operates through an opening in the lower side of a brush housing. The hopper is separated into a debris receiving compartment and a filter compartment. An air fan and an associated duct recirculates air from the far end of the debris compartment to a zone adjacent the brush.

AU 29608 89 A discloses a further industrial sweeping apparatus.

SUMMARY OF THE INVENTION

It is an object of the present invention to provide a nozzle arrangement that shows a good cleaning performance, while it preferably is of small size, easy to use and less cost-intensive for the user. Preferably, the above-mentioned blowing effect is overcome in an even more efficient way. The invention is defined by the independent claims.

One aspect of the invention provides a nozzle arrangement comprising:

a brush rotatable about a brush axis, the brush being provided with flexible brush elements having tip portions for contacting the surface to be cleaned and picking up dirt and/or liquid particles from the surface during the rotation of the brush, wherein the brush is at least partly surrounded by a nozzle housing and protrudes at least partly from a bottom side of the nozzle housing, a drive unit for rotating the brush, a squeegee element which is spaced apart from the brush and attached to the bottom side of the nozzle housing on a first side of the brush where the brush elements enter the nozzle housing during the rotation of the brush, wherein the squeegee element is configured for wiping dirt and/or liquid particles across or off the surface to be cleaned during a movement of the cleaning device, a deflector for contacting the brush and deflecting the brush elements during the rotation of the brush, and a restriction element for at least partly restricting air from getting sucked into the nozzle housing at a second side of the brush where the brush elements leave the nozzle housing, wherein the restriction element is, seen in a rotation direction of the brush, arranged behind the deflector, such that the brush elements, during the rotation of the brush, contact the deflector before passing the restriction element and then leaving the nozzle housing at the bottom side, and wherein the restriction element comprises a mechanically flexible element that is, due to its flexibility, configured to follow an outer surface of the brush and to contact the tip portions during the rotation of the brush.

The above-mentioned object is furthermore, according to a second aspect of the present invention, achieved by a cleaning device comprising the above-mentioned nozzle arrangement and a vacuum aggregate for generating an under-pressure in a suction area between the nozzle housing and the brush.

Preferred embodiments of the invention are defined in the dependent claims. It shall be understood that the claimed nozzle arrangement has similar and/or identical preferred embodiments as the claimed cleaning device and as defined in the dependent claims.

Similar as proposed in WO 2010/041184 A1 the brush, which is used according to the present invention, is equipped with thin flexible bristles, which are herein generally denoted as flexible brush elements. Due to these flexible brush elements the brush is, in contrast to agitators with hard/stiff brush elements, able to not only pick up dirt particles, but also to pick up liquid.

In contrast to the solution provided in WO 2010/041184 A1 only one single brush (not two counter-rotating brushes) is provided according to the present invention. In addition thereto the cleaning device according to the present invention is furthermore equipped with a squeegee element, which may also be simply denoted as squeegee. The squeegee element is preferably realized as a flexible rubber lip that is configured to glide over the surface to be cleaned and thereby wipe dirt and/or liquid particles across or off the floor during a movement of the cleaning device. The combination of a single rotating brush with flexible bristles, a squeegee and a vacuum aggregate for generating an under-pressure within the nozzle housing allows to easily ingest dirt and/or liquid particles at the same time. With such a cleaning device a surface may thus be cleaned from coarse dirt and mopped with liquid at the same time.

The squeegee element is preferably arranged on a first side of the brush where the brush elements enter the nozzle housing during the rotation of the brush. The squeegee element is thus arranged on the side of the brush, where the dirt particles and liquid droplets are released from the brush. Due to the flexibility of the brush elements, the brush elements act as a kind of whip that smashes off the dirt and/or liquid particles as soon as they are during their rotation released from the surface to be cleaned. This relies on the fact that the flexible brush elements are bent or indented as soon as they come into contact with the surface to be cleaned and straighten out as soon as they lose contact from the floor. This principle will be explained in detail further below.

Due to the position of the squeegee element, the dirt and/or liquid particles that are released/smashed away from the brush will hit against the squeegee element, bounce forth and back between the squeegee and the brush, and will finally be ingested by the vacuum aggregate. Some of the dirt and/or liquid particles will however re-spray onto the floor. However, this effect of re-spraying is overcome according to the present invention, since the squeegee element acts as a kind of wiper that collects these re-sprayed particles, so that also these particles may be ingested by the vacuum aggregate.

One of the central features of the cleaning device according to the present invention is the usage of a deflector and a restriction element. Similar as proposed in WO 2010/041184 A1 the deflector contacts the brush and deflects the brush elements during the rotation of the brush. This deflector has, similar as proposed in WO 2010/041184 A1, the function to press the brush elements together by deflecting them. In this way air, which is present in the space between the brush elements, is pushed out of the space. When the brush elements are, after leaving the deflector, moved apart from each other again, the space in between the brush elements increases so that air will be sucked into the brush, where an under-pressure is created that sucks in dirt and/or liquid particles. The deflector therefore compensates for the above-mentioned blowing effect of the brush that is generated by the rotating brush at the position where it leaves the nozzle housing right before coming into contact with the floor.

In contrast to the solution proposed in WO 2010/041184 A1 a restriction element is provided in addition to the deflector. This restriction element is configured to at least partly restrict air from getting sucked into the nozzle housing at a second side of the brush where the brush elements leave the nozzle housing. This second side is the side of the brush that is opposite the brush's first side, where the squeegee element is arranged. On this second side of the brush it should be prevented that too much air is getting sucked into the nozzle housing, as this would result in less under-pressure, i.e. increase the absolute pressure within the so-called suction area in the nozzle housing. By at least partly restricting air from getting sucked into the nozzle housing at the above-mentioned second side of the brush, the restriction element therefore prevents a loss of under-pressure in the areas of the nozzle housing where the under-pressure is needed to ingest the dirt and/or liquid particles.

The restriction element therefore acts as a kind of sealing at the second side of the brush and thereby minimizes the requirements to the vacuum aggregate. A relatively small vacuum aggregate may therefore serve to apply a sufficiently high under-pressure within the nozzle housing. Such small vacuum aggregates are not only less space-consuming, but also cheaper, so that production costs may be saved. On the other hand, small vacuum aggregates are less noisy compared to large powerful vacuum aggregates.

Regarding this fact it would of course be optimal to almost completely seal the nozzle housing at the second side of the brush where the brush elements leave the nozzle housing. However, in this case the above-mentioned blowing effect caused by the indentation of the brush during floor contact would not be overcome, since then no air at all counteracting the blowing effect could enter the nozzle housing at this side (at the second side of the brush).

On the other hand, only providing a deflector as proposed in WO 2010/041184 A1 would in the case of a single brush-squeegee-combination (as proposed herein) not be capable of fulfilling the above-mentioned sealing properties that prevent an unwanted loss of under-pressure within the nozzle housing. Without an additional restriction element the deflector would on the one hand allow enough air to get sucked into the nozzle housing at the second side of the brush in order to cancel out the unwanted blowing behavior, which, however, on the other hand would significantly reduce the under-pressure within the nozzle housing. The restriction element alone would serve to overcome the latter-mentioned problem, but would not be able to counteract the unwanted blowing effect. It is thus exactly the combination of the deflector and the restriction element that makes the cleaning device according to the present invention so valuable.

In contrast to a situation where only a deflector would be provided, so that air could immediately enter the brush after being deflected/indented by the deflector, the restriction element forms a restriction wall that follows the stretching brush elements and at least partly seals the nozzle housing in this area. This causes a local under-pressure in the brush in the area where the brush passes the restriction element. Because of this under-pressure air enters the brush as soon as the restriction wall ends before the brush elements come into contact with the floor. This under-pressure causes an air flow that cancels out the above-mentioned blowing effect of the brush.

From the foregoing it should become apparent that for a correct function of the cleaning device it is important that the restriction element is, seen in a rotation direction of the brush, arranged behind the deflector. In this way the brush elements contact the deflector during the rotation of the brush before passing the restriction element and then leaving the nozzle housing at the bottom side.

The usage of a restriction element has a further positive effect. The restriction element also serves as a kind of flow equalizer that facilitates a constant flow-rate of air entering the nozzle housing.

The main part of the dirt and/or liquid particles are collected and ingested from the surface at a first side of the brush, i.e. between the brush and the squeegee element. This first side of the brush shall be herein also denoted as suction inlet. The flow equalizing property is especially important due to the behavior of the squeegee element. The behavior of the squeegee element is different depending on the direction of movement of the cleaning device. This shall be explained in the following.

According to an embodiment of the present invention, the squeegee element comprises a switching unit for switching the squeegee element to a closed position, in which the squeegee element is adapted to push or wipe dirt and/or liquid particles across or off the surface to be cleaned, when the cleaning device is moved on the surface in a forward direction in which the squeegee element is, seen in the direction of movement of this cleaning device, located behind the brush, and for switching the squeegee element to an open position in which dirt and/or liquid particles from the floor can enter the suction area through an opening between the squeegee element and the surface to be cleaned, when the cleaning device is moved on the surface in a backward direction in which the squeegee element is, seen in the direction of movement of the cleaning device, located in front of the brush.

The ability to switch the squeegee element from an open to a closed position depending on the movement direction of the cleaning device enables a good cleaning result in a forward as well as in a backward stroke of the nozzle. The open configuration is in order to allow the dirt to enter when the squeegee approaches dirt and liquid on the floor before the brush. In the closed position the squeegee closes the gap to the floor, or in other words wipes or glides over the surface, when the brush approaches the dirt or liquid on the floor before the squeegee.

In order to guarantee the switching mode the squeegee element is preferably realized by a flexible rubber lip that, depending on the movement direction of the cleaning device is adapted to flex about the longitudinal direction of the rubber lip. This rubber lip preferably comprises at least one stud which is arranged near the lower end of the rubber lip, where the rubber lip is intended to touch the surface to be cleaned. The at least one stud is being adapted to at least partly lift the rubber lip from the surface, when the cleaning device is moved on the surface in a backward direction, in which the rubber lip, seen in the direction of movement of the cleaning device, located in front of the brush. Due to this lifting of the rubber lip in a backward stroke of the nozzle, coarse dirt may enter the nozzle also in a backward stroke through the opening created between the squeegee element and the surface to be cleaned. When moving the cleaning device on the surface in the opposite forward direction the stud is free from contact to the floor, leaving the rubber lip freely glide over the floor in order to pick-up dirt and water particles from the floor.

It becomes apparent that due to this flipping behavior of the squeegee the flow rate of air entering the suction inlet is different in a forward stroke than in a backward stroke of the nozzle. In the forward stroke the squeegee kind of closes the suction inlet, which in turn decreases the flow rate and increases the under-pressure within the nozzle housing (i.e. decreases the absolute pressure within the nozzle housing). In the backward stroke the squeegee on the other hand gets lifted to open the suction inlet from this side, such that the flow rate of air getting sucked into the nozzle housing in this area increases. In other words, this leads to a rather large air leakage enabling additional air to enter the suction inlet through the created openings between the squeegee and the floor. As a result, the under-pressure within the nozzle housing decreases (i.e. the absolute pressure within the nozzle housing increases).

Since the above-mentioned restriction element at least partly seals the nozzle housing at the second side of the brush, it facilitates a constant flow rate of air entering the suction inlet (between the brush and the squeegee) independent of the movement direction of the cleaning device. In case only a deflector would be used (without a restriction element), the sealing function at the second side of the brush would, especially in the forward stroke when the pressure difference over the deflector is relatively high, not be sufficient. The relatively short restriction path provided by such a deflector would not be sufficiently long to enable a sufficiently large restriction for air to enter. Therefore, small and low-power consuming vacuum aggregates could not be used to generate the required under-pressure within the nozzle housing.

According to a preferred embodiment of the present invention, the restriction element comprises a mechanically flexible element. Alternatively, the restriction element may be realized as a mechanically flexible element. Due to its flexibility such a mechanically flexible element may almost perfectly follow an outer surface of the brush and thereby only contact the tip portions of the brush during the brush's rotation.

Due to the under-pressure that is generated within the nozzle housing, the mechanically flexible restriction element therefore gets almost automatically sucked against the brush. In contrast to the deflector, which actively deflects/indents the brush elements, the brush elements are not indented when being contacted by the flexible restriction element. As the restriction element is actively sucked against the outer surface of the brush, a very good sealing effect may be realized in between the restriction element and the brush.

The mechanical flexibility of the restriction element also has a further advantage. Since it only contacts the tip portions of the brush in a very soft manner, the friction caused between the brush and the restriction element is decreased as much as possible. Otherwise, if this low friction was not guaranteed, larger and more powerful motors (drive unit) would have to be used for rotating the brush with sufficiently high accelerations.

In order to being able to realize a restriction element that almost perfectly adapts its shape to the outer contours of the brush the restriction element is, according to a preferred embodiment of the present invention, made of a sheet of fabric material, rubber or plastic. Such a very thin sheet of fabric material, rubber or plastic is not only due to its mechanical flexibility but also due to its low weight almost perfectly adaptive to the shape of the brush as soon as an under-pressure is applied. It generates almost no friction. Exemplary fabric materials that may be used for this purpose are nylon, polyester, etc.

According to a further embodiment of the present invention, the deflector is also made of a mechanically flexible material. However, the deflector does not have to be as flexible as the restriction element, since it has to be suitable for deflecting/indenting the brush elements as mentioned before. A too stiff deflector could on the other hand damage the brush elements and thereby increase wear and tear of the brush. Therefore, the deflector may be also made of rubber, so that wear and tear of the brush elements is minimized as much as possible.

According to a further embodiment the restriction element comprises a plurality of slits that are arranged parallel to each other and perpendicular to the brush axis. These slits are small longitudinal openings within the restriction element. They facilitate dirt and liquid particles on the floor to encounter the brush through the restriction element. The restriction element in this case has several flexible strips or flaps that are separated from each other via the very thin slits. These flexible strips of the restriction element may also overlap each other. In any case it must be guaranteed that the slits are not too large, since this would again result in a lost of under-pressure within the nozzle housing.

According to a further embodiment of the present invention, the restriction element is connected to the deflector and the deflector is attached to the nozzle housing. The deflector could, for example, be fixedly arranged at an interior part of the nozzle housing and the restriction element could be directly attached to the deflector. However, it is to be noted that the deflector and the restriction elements may also be realized as separate parts that may be separately attached or fixed to the interior of the nozzle housing. In any case it is preferred that the restriction element is arranged very close to the deflector, such that the above-mentioned properties of the deflector-restriction element-combination may be achieved. According to another embodiment the deflector and the restriction element may be both separately connected to the nozzle housing and the flexible restriction element may lay over the deflector. The first part of the restriction element that lays over the deflector in this case has the deflector function, whereas the other part of the restriction element (not laying over the deflector) serves for the above-mentioned air restriction properties.

According to a further embodiment of the present invention, the restriction element and the deflector are arranged on the second side of the brush where the brush elements leave the nozzle housing during the rotation of the brush, wherein the second side is opposite to the first side with respect to the brush axis.

The first side is the side where the squeegee is arranged. This means that the squeegee is arranged on one side of the brush (the first side) and the deflector as well as the restriction element are arranged on the other side of the brush (second side). All three elements (the squeegee element, the deflector and the restriction element) are preferably arranged on the interior of the nozzle housing. The first side of the brush, i.e. the space between the brush and the squeegee, is the side where the suction inlet is located, i.e. from where the dirt and/or liquid particles picked up by the brush are being lifted and ingested.

In the following the specific properties of the brush, which enable the brush to pick up dirt and/or liquid particles at the same time (in contrast to an agitator), will be explained in detail.

According to a further preferred embodiment of the present invention, the linear mass density of a plurality of the brush elements is, at least at the tip portions, lower than 150 g/10 km, preferably lower than 20 g/10 km.

In contrast to brushes often used according to the prior art, which are only used for stain removal (so-called adjutators), a soft brush with flexible brush elements as presented here also has the ability to pick-up water from the floor. Due to the flexible microfiber hairs that are preferably used as brush elements, dirt particles and liquid can be picked up from the floor when the brush elements/micro-fiber hairs contact the floor during the rotation of the brush. The ability to also pick-up water with a brush is mainly caused by capillary and/or other adhesive forces that occur due to the chosen linear mass density of the brush elements. The very thin micro-fiber hairs furthermore make the brush open for coarse dirt. The micro-fiber hairs also have the advantage that the hairs serve as a flow restriction when passing the restriction element. Stiff hairs of an adjutator could instead not do so.

It is to be noted that the linear mass density as mentioned, i.e. the linear mass density in gram per 10 km, is also denoted as Dtex value. A very low Dtex value of the above-mentioned kind ensures that, at least at the tip portions, the brush elements are flexible enough to undergo a bending effect and are able to pick-up dirt particles and liquid droplets from the surface to be cleaned. Furthermore, the extent of wear and tear of the brush elements appears to be acceptable within this linear mass density range.

The experiments carried out by the applicant have proven that a Dtex value in the above-mentioned range appears to be technically possible and that good cleaning results can be obtained therewith. However, it has shown that cleaning results can be further improved by applying brush elements with an even lower upper limit of the Dtex value, such as a Dtex value of 125, 50, 20 or even 5 (in g/10 km).

According to a further preferred embodiment of the present invention, the drive unit is adapted to realize a centrifugal acceleration at the tip portions of the brush elements which is, in particular during a dirt release period when the brush elements are free from contact to the surface during rotation of the brush, at least 3,000 $m/s^2$, more preferably at least 7,000 $m/s^2$, and most preferably 12,000 $m/s^2$.

It is to be noted that the minimum value of 3,000 $m/s^2$ in respect of the acceleration which is prevailing at the tip portions at least during a dirt release period when the brush elements are free from contact to the surface during the rotation of the brush, is also supported by results of experiments which have been performed in the context of the present invention. These experiments have shown that the cleaning performance of the device according to the present invention improves with an increase of the angular velocity of the brush, which implies an increase of the acceleration at the tip portions of the brush elements during rotation.

When the drive unit is adapted to realize centrifugal accelerations of the brush elements in the above-mentioned ranges, it is likely for the liquid droplets adhering to the brush elements to be expelled as a mist of droplets during a phase in which the brush elements are free from contact to the surface to be cleaned.

Combining the above-mentioned parameters for the linear mass density of the flexible brush elements with the parameters for the acceleration of the tips of the brush elements yields optimal cleaning performance of the rotatable brush, wherein practically all dirt particles and spilled liquid encountered by the brush are picked up by the brush elements and expelled at a position inside the nozzle housing.

A good combination of the linear mass density and the centrifugal acceleration at the tip portions of the brush elements is providing an upper limit for the Dtex value of 150 g/10 km and a lower limit for the centrifugal acceleration of 3,000 m/s$^2$. This parameter combination has shown to enable for excellent cleaning results, wherein the surface is practically freed of particles and dried in one go. Using this parameter combination has also shown to result in very good stain removing properties. The ability to also pick-up liquid/water with a brush is mainly caused by capillary and/or other adhesive forces that occur due to the chosen linear mass density of the brush elements and the occurring high speeds with which the brush is driven.

The combination of the above-mentioned parameters concerning the linear mass density and the realized centrifugal acceleration at the tip portions of the brush elements is not found on the basis of knowledge of the prior art. The prior art is not even concerned with the possibility of having an autonomous, optimal functioning of only one rotatable brush which is used for cleaning a surface and is also able to lift dirt and liquid.

In order to realize the above-mentioned centrifugal accelerations at the tip portions of the brush elements, the drive unit is, according to an embodiment of the present invention, adapted to realize an angular velocity of the brush which is in a range of 3,000 to 15,000 revolutions per minute, more preferably in a range of 5,000 to 8,000 revolutions per minute, during operation of the device. Experiments of the applicant have shown that optimal cleaning results can be obtained, when the brush is driven at an angular velocity which is at least 6,000 revolutions per minute.

However, the desired accelerations at the tip portions of the brush elements do not only depend on the angular velocity, but also on the radius, respectively on the diameter of the brush.

It is therefore, according to a further embodiment of the invention, preferred that the brush has a diameter which is in a range of 10 to 100 mm, more preferably in a range of 20 to 80 mm, and most preferably in a range of 35 to 50 mm, when the brush elements are in a fully outstretched condition. The length of the brush elements is preferably in a range of 1 to 20 mm, more preferably in a range of 8 to 12 mm, when the brush elements are in a fully outstretched condition.

According to a further embodiment, the vacuum aggregate is configured to generate an under-pressure within the suction area in a range of 3 to 70 mbar, preferably in a range of 4 to 50 mbar, most preferably in a range of 5 to 30 mbar.

In contrast to the above-mentioned pressure ranges that are generated by the vacuum aggregate, state of the art vacuum cleaners need to apply higher under-pressures in order to receive acceptable cleaning results. However, due to the above-mentioned combination of the special brush with flexible brush elements, the squeegee element, the deflector and the restriction element, very good cleaning results may already be realized in the above-mentioned pressure ranges. Thus, also smaller vacuum aggregates may be used. This increases the freedom in the selection of the vacuum pump.

The presented cleaning device may further comprise a positioning unit for positioning the brush axis at a distance to the surface to be cleaned that is smaller than the radius of the brush with fully outstretched brush elements, to realize an indentation of the brush part contacting the surface to be cleaned during operation, which indentation is in a range from 2% to 12% of the brush diameter.

As a result, the brush elements are bent when the brush is in contact with the floor. Hence, as soon as the brush elements come into contact with the floor during rotation of the brush, the appearance of the brush elements changes from an outstretched appearance to a bent appearance, and as soon as the brush elements lose contact with the floor during rotation of the brush, the appearance of the brush elements changes from a bent appearance to an outstretched appearance. The same brush characteristics occur when the tip portions of the brush contact the first deflection surface of the first deflection element.

A practical range for an indentation of the brush is arranged from 2% to 12% of a diameter of the brush relating to a fully outstretched condition of the brush elements. In practical situations, the diameter of the brush as mentioned can be determined by performing an appropriate measurement, for example, by using a high-speed camera or a stroboscope which is operated at the frequency of a rotation of the brush.

A deformation of the brush elements, or, to say it more accurately, a speed at which deformation can take place, is also influenced by the linear mass density of the brush elements. Furthermore, the linear mass density of the brush elements influences the power which is needed for rotating the brush. When the linear mass density of the brush elements is relatively low, the flexibility is relatively high, and the power needed for causing the brush elements to bend when they come into contact with the surface to be cleaned or with the first deflection surface is relatively low. This also means that a friction power which is generated between the brush elements and the floor or the first deflection surface is low, whereby any damages are prevented. Other advantageous effects of a relatively low linear mass density of the brush elements are a relatively high resistance to wear, a relatively small chance of damage by sharp objects or the like, and the capability to follow the surface to be cleaned in such a way that contact is maintained even when a substantial unevenness in the floor is encountered.

A factor which may play an additional role in the cleaning function of the rotatable brush is a packing density of the brush elements. When the packing density is large enough, capillary effects may occur between the brush elements, which enhance fast removal of liquid from the surface to be cleaned. According to an embodiment of the present invention the packing density of the brush elements is at least 30 tufts of brush elements per cm$^2$, wherein a number of brush elements per tuft is at least 500.

Arranging the brush elements in tufts forms additional capillary channels, thereby increasing the capillary forces of the brush for picking-up dirt particles and liquid droplets from the surface to be cleaned.

As it has been mentioned above, the presented cleaning device has the ability to realize extremely good cleaning results. These cleaning results can be even improved by actively wetting the surface to be cleaned. This is especially advantageous in case of stain removal. The liquid used in the process of enhancing adherence of dirt particles to the brush elements may be provided in various ways. In a first place, the rotatable brush and the flexible brush elements may be wetted by a liquid which is present on the surface to be cleaned. An example of such a liquid is water, or a mixture of water and soap. Alternatively, a liquid may be provided to the flexible brush elements by actively supplying the cleansing liquid to the brush, for example, by oozing the liquid onto the brush, or by injecting the liquid into a hollow core element of the brush.

According to an embodiment, it is therefore preferred that the cleaning device comprises a unit for supplying a liquid to the brush at a rate which is lower than 6 ml per minute per cm of a width of the brush in which the brush axis is extending. It appears that it is not necessary for the supply of liquid to take place at a higher rate, and that the above-mentioned rate suffices for the liquid to fulfill a function as a carrying/transporting tool for dirt particles. Thus, the ability of removing stains from the surface to be cleaned can be significantly improved. An advantage of only using a little liquid is that it is possible to treat delicate surfaces, even surfaces which are indicated as being sensitive to a liquid such as water. Furthermore, at a given size of a reservoir containing the liquid to be supplied to the brush, an autonomy time is longer, i.e. it takes more time before the reservoir is empty and needs to be filled again.

It has to be noted that, instead of using an intentionally chosen and actively supplied liquid, it is also possible to use a spilled liquid, i.e. a liquid which is to be removed from the surface to be cleaned. Examples are spilled coffee, milk, tea, or the like. This is possible in view of the fact that the brush elements, as mentioned before, are capable of removing the liquid from the surface to be cleaned, and that the liquid can be removed from the brush elements under the influence of centrifugal forces as described in the foregoing.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
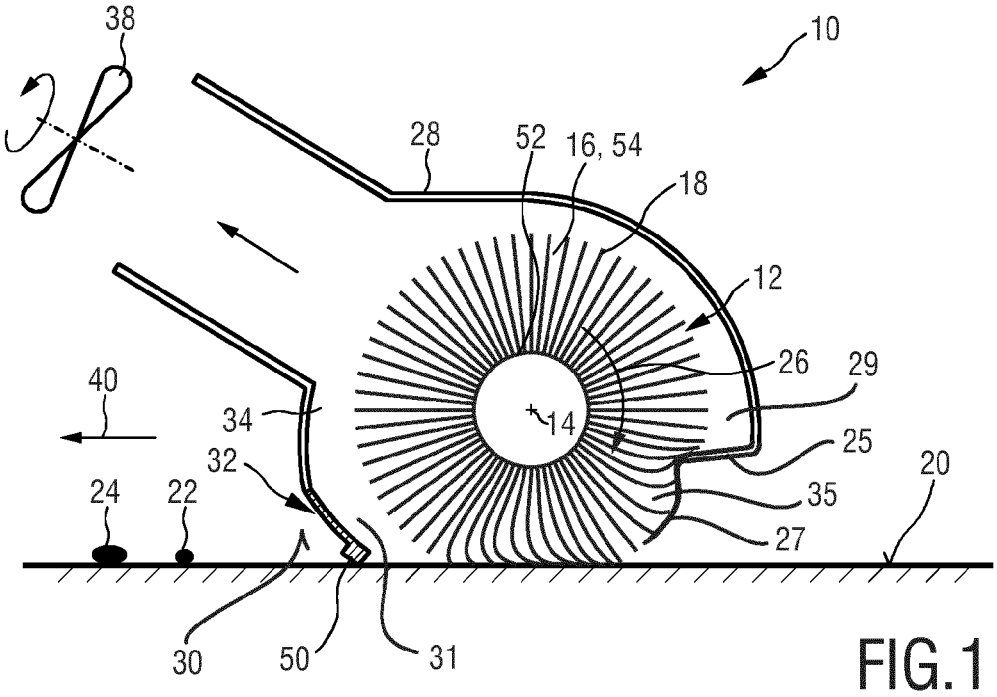
FIG. 1 shows a schematic cross-section of a first embodiment of a nozzle arrangement of a cleaning device according to the present invention, in a first working position.

FIG. 1 shows a schematic cross-section of a first embodiment of a nozzle arrangement 10 of a cleaning device 100 according to the present invention. The nozzle arrangement 10 comprises a brush 12 that is rotatable about a brush axis 14. The brush 12 is provided with flexible brush elements 16 which are preferably realized by thin microfiber hairs. The flexible brush elements 16 comprise tip portions 18 which are adapted to contact a surface to be cleaned 20 during the rotation of the brush and to pick-up dirt particles 22 and/or liquid particles 24 from the surface 20 (floor 20) during a pick-up period when the brush elements 16 contact the surface 20.

Further, the nozzle arrangement 10 comprises a drive unit, e.g. a motor (not shown), for driving the brush 12 in a predetermined direction of rotation 26. The drive unit is preferably adapted to realize a centrifugal acceleration at the tip portions 18 of the brush elements 16 which is, in particular during a dirt release period when the brush elements 16 are free from contact to the surface 20 during the rotation of the brush 12, at least 3,000 $m/s^2$.

The brush 12 is at least partly surrounded by a nozzle housing 28. The arrangement of the brush 12 within the nozzle housing 28 is preferably chosen such that the brush 12 at least partially protrudes from a bottom side 30 of the nozzle housing 28. During use of the device 100, the bottom side 30 of the nozzle housing 28 faces towards the surface to be cleaned 20.

Also attached to the bottom side 30 of the nozzle housing 28 is a squeegee element 32. This squeegee element 32 is arranged such that it contacts the surface to be cleaned 20 during the use of the device 100. The squeegee is used as a kind of wiper for pushing or wiping dirt particles 22 and/or liquid particles across or off the surface 20 when the cleaning device 100 is moved. The squeegee 32 extends substantially parallel to the brush axis 14. The nozzle housing 28, the squeegee 32 and the brush 12 together define a suction area 34, which is located within the nozzle housing 28. It is to be noted that the suction area 34, in the meaning of the present invention, not only denotes the area between the brush 12, the squeegee 32 and the nozzle housing 28, but also denotes the space between the brush element 16 for the time during the rotation of the brush 12, in which the brush elements 16 are inside the nozzle housing 28. The suction area 34 denotes as well an area that is defined between the squeegee 32 and the brush 12. The latter area will be in the following also denoted as suction inlet 36, which opens into the suction area 34.

A vacuum aggregate 38, which is in these figures only shown in a schematic way, generates an under-pressure in the suction area 34 for ingesting dirt particles 22 and liquid particles 24 that have been encountered and collected by the brush 12 and the squeegee 32. According to the present invention the under-pressure preferably ranges between 3 and 70 mbar, more preferably between 4 and 50 mbar, most preferably between 5 and 30 mbar. This under-pressure is, compared to regular vacuum cleaners which apply an under-pressure of around 70 mbar, quite low. However, due to the properties of the brush 12, which will be explained further below, very good cleaning results may already be realized in the above-mentioned pressure ranges. Thus, also smaller vacuum aggregates 38 may be used. This increases the freedom in the selection of the vacuum pump.

During the rotation of the brush 12 dirt and/or liquid particles 22, 24 will be encountered on the surface 20 and either launched towards the inside of the nozzle housing 28 or against the squeegee 32. If the particles 22, 24 are launched against the squeegee 32 they will get reflected therefrom. These reflected particles 22, 24 will again reach the brush 12 and get launched again. In this way the particles 22, 24 bounce forth and back between the brush 12 and the squeegee 32 in an more or less zigzag-wise manner after they are finally ingested by the vacuum aggregate 38. Some of the dirt and/or liquid particles 22, 24 will however get launched from the surface 20 in such a flat manner that they will be resprayed back onto the surface 20 in the area between the brush 12 and the squeegee 32. Since the squeegee 32 acts as a kind of wiper, these particles 22, 24 will not get launched out of the nozzle housing 28 again. Due to the under-pressure that is applied by the vacuum aggregate 38 these re-sprayed particles 22, 24 will then also be ingested by the vacuum aggregate 38.

FIG. 1 furthermore illustrates one of the central features of the cleaning device 100 according to the present invention. A deflector 25 is arranged on a second side 29 of the brush 12 in the area where the brush elements 16 leave the nozzle housing 28 during the brush's rotation. This deflector 25 contacts the brush 12 and deflects the brush elements 16 during the rotation of the brush 12. The deflector 25 is sometimes also denoted as spoiler. The deflector 25 projects from an interior of the nozzle housing 28 towards the brush 12. The deflector 25 is preferably connected to the nozzle housing 28. This connection may either be a releasable or a fixed connection.

Figure 6:
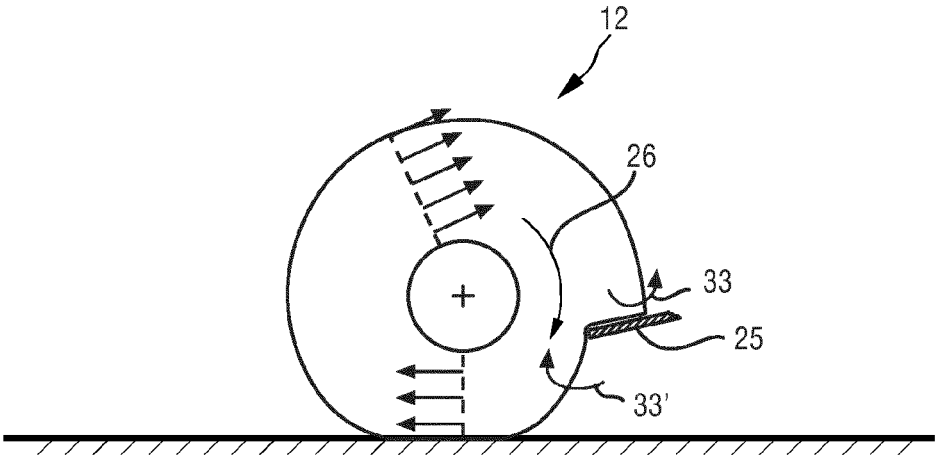
FIG. 6 schematically illustrates the working principle of a deflector and restriction element that are used according to the present invention.

The deflector 25 has the function to prevent an unwanted blowing effect of the brush 12 at the second side 29, where the brush elements 16 leave the nozzle 28 during the rotation of the brush 12. Without the deflector 25 the brush 12 would act as a kind of gear pump which pumps air from the inside of the nozzle housing 28 to the outside. This blowing effect would cause dirt and/or liquid particles 22, 24 to be blown away, so that they could not be encountered anymore by the brush 12 (see FIG. 2). The deflector 25 has the function to press the brush elements 16 together and to bend them as soon as they hit against the deflector 25. In this way air, which is present in the space between the brush elements 16, is pushed out of the space. This principle is schematically illustrated in FIG. 6. Therein, the arrow 33 indicates the air that is pushed out of the brush 12 due to the deflector 25. The position where the air is blown out of the brush 12 is therefore changed from outside the nozzle housing 28 to the inside of the nozzle housing 28. In the area where the brush elements 16 leave the nozzle housing 28 no such unwanted blowing effect occurs anymore.

If only a deflector 25 was provided, the brush elements 16 would move apart from each other directly after leaving the deflector 25. The space in between the brush elements 16 would then increase immediately so that air would be sucked into the brush 12 right after the point where the brush elements 16 leave the deflector 25. This air flow is schematically indicated by arrow 33' in FIG. 6. It should be noted that the air flow 33' does not only result from the effect mentioned before, but is also a result of the pressure difference of the pressure within the nozzle housing 28 compared to the pressure in the exterior.

It has however been found that a too strong air flow 33' on the second side 29 of the brush 12 could counteract some other advantageous properties of the cleaning device 100. If this air stream 33' becomes too large, too much air would get sucked into the nozzle housing 28 on the second side 29. This could lower the under-pressure within the suction area 34, i.e. the absolute pressure within the suction area 34 would be increased. In order to still being able to generate a sufficiently high under-pressure within the suction area 34 a very powerful vacuum aggregate 38 would then have to be used. The inventors have however found a way to also overcome this problem.

As shown in FIG. 1, the nozzle arrangement 10 further comprises a restriction element 27. This restriction element at least partly restricts air from getting sucked into the nozzle housing 28 at the second side 29 of the brush 12. The restriction element 27 forms a kind of sealing right after the deflector 25.

In contrast to the situation schematically illustrated in FIG. 6 air will thus not get sucked into the brush 12 immediately after the brush elements 16 pass the deflector 25. In contrast to the situation schematically illustrated in FIG. 6 the restriction element 27 forms a kind of restriction wall that follows the stretching brush elements 16 after they have been deflected by the deflector 25. The restriction element 27 thus creates a longer path for air to enter the nozzle. This results in an increased resistance/restriction, so that less air will enter the front side of the nozzle. Therefore, a local under-pressure is generated between the brush elements 16 in an area, which is in FIG. 1 denoted with reference numeral 35. Because of this under-pressure air enters the brush 12 as soon as the restriction wall 27 ends. The resulting flow cancels the blowing behavior of the brush 12.

From the foregoing it becomes apparent that it is the combination of the deflector 25 and the restriction element 27 that allows on one hand to cancel out the unwanted blowing behavior of the brush 12 and on the other hand serves for a sufficient sealing on the side of the brush 12, where the brush elements 16 leave the nozzle housing 28 during the brush's rotation.

The deflector 25 as well as the restriction element 27 are preferably made of a mechanically flexible material. Since the deflector 25 has to deflect/bend the brush elements 16, the deflector 25 is preferably stiffer than the restriction element 27. The deflector 25 may, for example, be made of rubber. However, also other materials are generally conceivable. A relatively soft material has the advantage that it does not damage the brush elements 16 when deflecting them.

The restriction element 27 is preferably made of a thin sheet of fabric material, rubber or plastic. Such a flexible restriction element is, due to its flexibility, suitable to follow the outer surface of the brush 12 and to only contact the tip portions 18 of the brush elements 16. Due to the generated under-pressure the restriction element 27 may in this way be sucked towards the brush 12, such that it forms a flexible restriction wall that almost perfectly follows the brush elements 16 after they have been deflected by the deflector 25. Due to its flexibility the restriction element 27 thus adapts its own shape to the outer contours of the brush 12. The very light weight materials (fabrics, rubber or plastic) that are used for the restriction element 27 have also shown to only generate a minimum of friction between the brush 12 and the restriction element 27. This is especially advantageous, since a too high friction therein between would counteract the drive unit that accelerates the brush 12. This would mean that larger motors would have to be used that consume a lot more energy, which is of course not desired.

It shall be also noted that the restriction element 27 is in all figures shown to exactly follow the outer contour of the brush 12. This is however only the fact if the brush 12 is rotating and an under-pressure is applied within the suction area 34. If the device is turned off and no under-pressure is applied the flexible restriction element 27 simply hangs loose.

The restriction element 27 furthermore serves as a flow equalizer. It facilitates a constant flow rate of air entering the side 29 of the nozzle housing 28 where the brush elements 16 leave the nozzle housing 28. This constant flow rate is especially important, since the squeegee element 32 flips depending on the movement direction 40 of the nozzle 10 between an open and a closed position. This will be explained in the following.

In order to guarantee a cleaning result in the backward stroke of the nozzle 10 (shown in FIG. 1) as well as in a forward stroke of the nozzle 10 (shown in FIG. 2) the squeegee element 32 comprises one or more studs 50 for switching the squeegee 32 from an open to a closed position and vice versa, depending on the direction of movement 40 of the nozzle 10 with respect to the surface 20. If the nozzle 10 is moved in a forward stroke (shown in FIG. 2) where the squeegee is, seen in the direction of movement 40, located behind the brush 12, the squeegee 32 is arranged in a close position. In this closed position the squeegee 32 is adapted to push or wipe dirt and/or liquid particles 22, 24 across or off the surface 20 by more or less gliding over the surface 20. In such a forward stroke the squeegee 32 then acts as a kind of wiper that collects the remaining water from the surface 20, which has not been lifted or has been sprayed back from the brush 12 to the surface 20. The remaining water 24 which is collected by the squeegee can then be ingested by means of the applied under-pressure.

On the other hand, the squeegee 32 is arranged in its open position when the nozzle 10 is moved in a backward stroke (shown in FIG. 1), in which the squeegee is, seen in the direction of movement 40 located in front of the brush, so that it would encounter the dirt and/or liquid particles 22, 24 on the surface before they would be encountered by the brush 12. In this backward stroke the studs 50 flip the squeegee 32 to its open position. In this open position dirt and/or liquid particles 22, 24 can then enter into the suction inlet 36 through openings that are created between the squeegee 32 and the surface to be cleaned 20.

If the squeegee 32 would not be switched to that open position only very small dirt particles 22 would be able to reach the suction inlet 36, while most of the dirt and/or liquid particles 22, 24 would be entangled by the squeegee 32 and pushed across the surface 20 without being able to enter the suction inlet 36. This would of course result in a poor cleaning and drying effect.

Figure 7A:
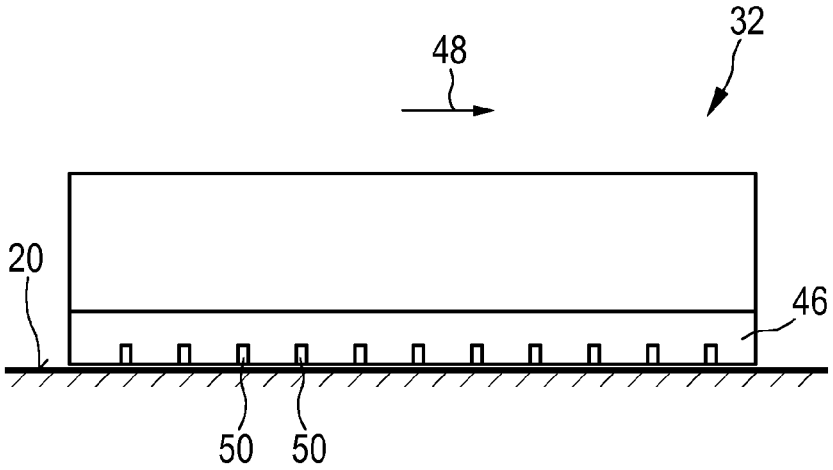
FIG. 7 shows a schematic top view (FIG. 7*a*) and a schematic cross-section (FIG. 7*b*) of a squeegee element of the cleaning device according to the present invention, in a first working position.
Figure 7B:
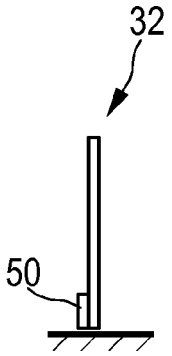

In order to guarantee this direction—dependent switching of the squeegee 32, the squeegee 32 preferably comprises a flexible rubber lip 46 that, depending on the movement direction 40, is adapted to flex about a longitudinal direction of the rubber lip 46. An enlarged schematic view of the squeegee 32 is shown in FIGS. 7 and 8 in a front end view and in a side view, respectively. FIG. 7 shows the squeegee in its closed position, whereas FIG. 8 shows a situation of the squeegee 32 in its open position.

Figure 8A:
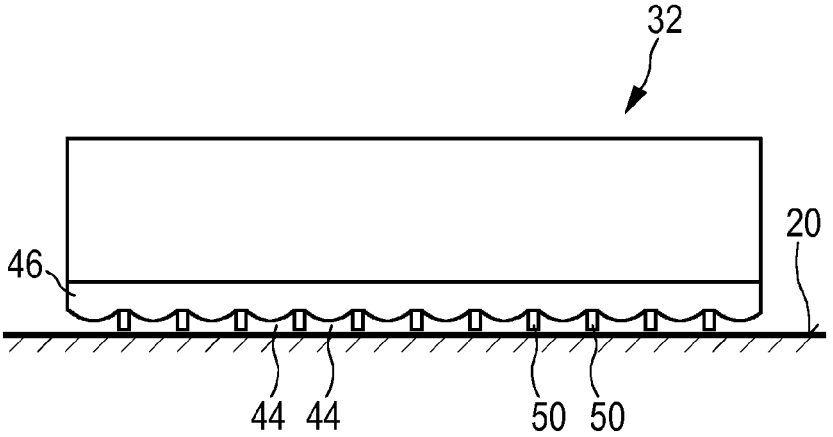
FIG. 8 shows a schematic top view (FIG. 8*a*) and a schematic cross-section (FIG. 8*b*) of the squeegee element shown in FIG. 7, in a second working position.
Figure 8B:
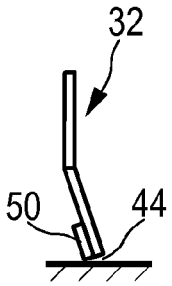

The studs 50 that are arranged near the lower end of the rubber lip 46, where the squeegee 32 is intended to touch the surface 20, are adapted to at least partly lift the rubber lip 46 from the surface 20, when the cleaning device is moved on the surface 20 in the backward direction 40 (as shown in FIGS. 1 and 8). In this case the rubber lip 46 is lifted, which is mainly due to the natural friction which occurs between the surface 20 and the studs 50. The studs 50 then act as a kind of stopper that decelerate the rubber lip 46 and forces it to flip over the studs 50. The squeegee 32 is thereby forced to glide on the studs 50, wherein the rubber lip 46 is lifted by the studs 50 and openings 44 occur in the space between the rubber lip 46 and the surface 20 (see FIGS. 8*a, b*).

Figure 2:
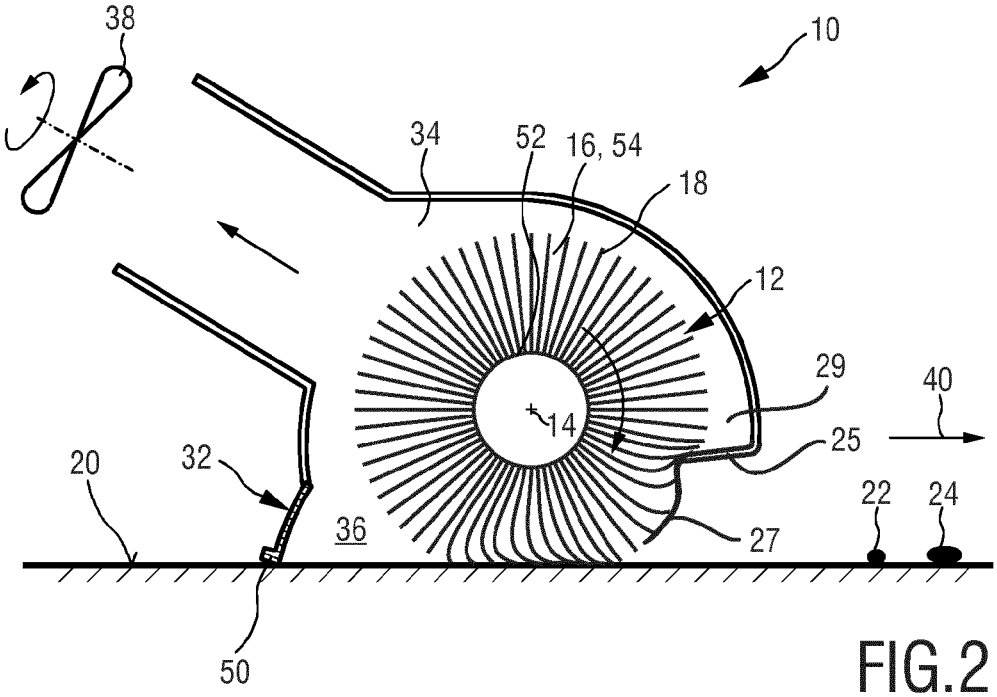
FIG. 2 shows a schematic cross-section of the first embodiment of the nozzle arrangement shown in FIG. 1, in a second working position.

It is evident that these openings 44 do not only enable dirt and/or liquid particles 22, 24 to enter the suction inlet 36. Also a lot more air will be sucked through the openings 44 into the suction area 34 compared to a forward stroke of the nozzle 10, where the squeegee 32 is in its closed position. This means that there is a difference in the flow behavior depending if the nozzle 10 is moved in a forward stroke (as shown in FIG. 2) or in a backward stroke (as shown in FIG. 1). The under-pressure within the suction area 34 will thus always be higher in the forward stroke (shown in FIG. 2) as in the backward stroke (shown in FIG. 1).

On the other hand, this means that the pressure difference over the deflector 25 and the restriction element 27 is relatively small within the backward stroke, whereas this pressure difference is relatively high in the forward stroke. Without the restriction element 27 the sealing function at the second side 29 of the nozzle housing 28 would then especially in the forward stroke not be sufficient. Even though the deflector 25 would—without the restriction element 27—still cancel out the above-mentioned unwanted blowing behavior of the brush 12, a lot of air would get sucked into the suction area 34 at the second side 29 of the brush 12, because of the high pressure difference at that side of the nozzle. In this case a sufficient under-pressure in the space between the squeegee 32 and the brush 12 (in the suction inlet 36) could only be generated with a very large and power consuming vacuum aggregate, when the nozzle 10 is moved in a forward direction. The herein proposed restriction element 27 however compensates for this, provides a sufficiently good sealing and therefore minimizes the requirements to the vacuum aggregate 38.

Figure 3:
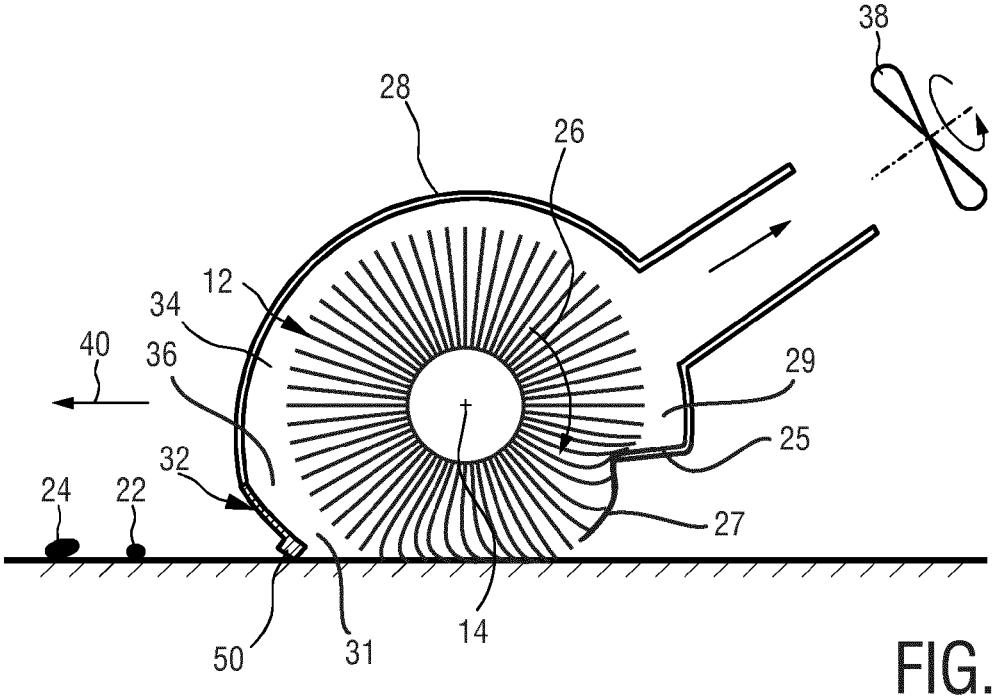
FIG. 3 shows a schematic cross-section of a second embodiment of the nozzle arrangement of the cleaning device according to the present invention, in a first working position.
Figure 4:
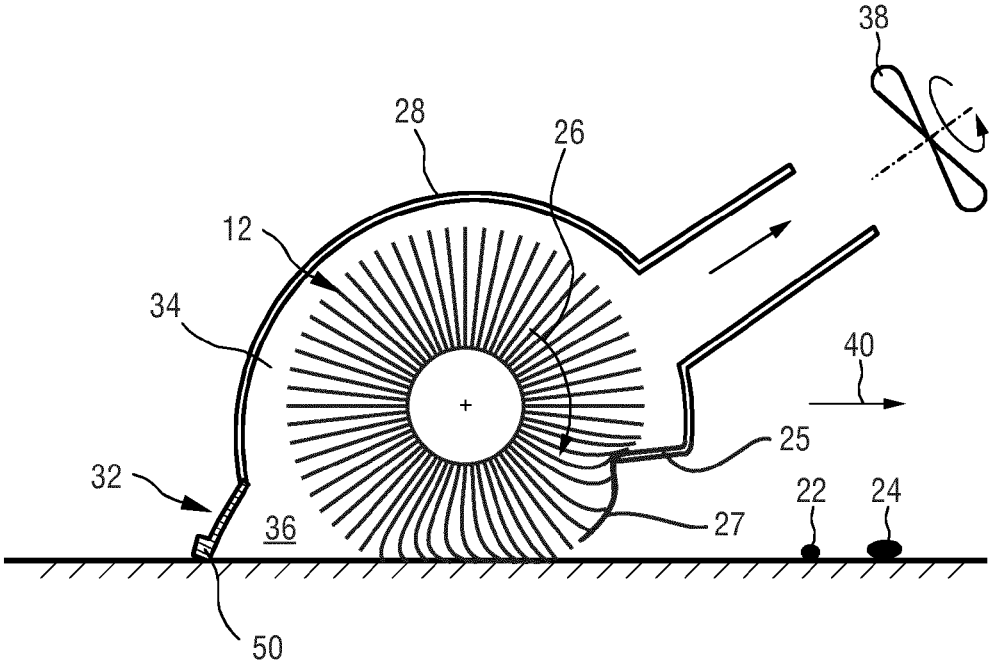
FIG. 4 shows a schematic cross-section of the second embodiment of the nozzle arrangement shown in FIG. 3, in a second working position.

FIGS. 3 and 4 show a second embodiment of the nozzle arrangement 10. These figures illustrate that the positions of the deflector 25 and the restriction element 27 can also be interchanged with a position of the squeegee 32 with respect to the brush 12. However, by comparing FIGS. 3 and 4 with FIGS. 1 and 2 it can be seen that the deflector 25 and the restriction element 27 are still arranged on the second side 29 of the brush 12, where the brush element 16 leave the nozzle housing 28. Similarly is the squeegee 32 still arranged on the first side 31 of the brush 12, where the brush elements 16 enter the nozzle housing 28 during the brush's rotation.

As it can be seen from FIG. 3, the squeegee 32 has to be in this case in an open position when the nozzle 10 is moved in a forward stroke, in which the nozzle 10 is moved in a direction 40 in which the squeegee 32 is, seen in the direction of movement 40, located in front of the brush 12. Otherwise, the dirt and/or liquid particles 22, 24 would again not be able to enter the suction inlet 36.

On the other hand, the squeegee 32 needs to be in its closed position when the nozzle is according to this embodiment moved in a backward stroke as shown in FIG. 4, where the brush 12 is, seen in the movement direction 40, located in front of the squeegee 32 and encounters the dirt and/or liquid particles 22, 24 first. The squeegee 32 in this case again acts as a wiper that glides over the surface 20 and collects the remaining dirt and/or liquid particles 22, 24 from the surface 20.

In both variants the deflector 25 and the restriction element 27 remain at the second side 29 where the brush elements 16 leave the nozzle housing 28.

Figure 5:
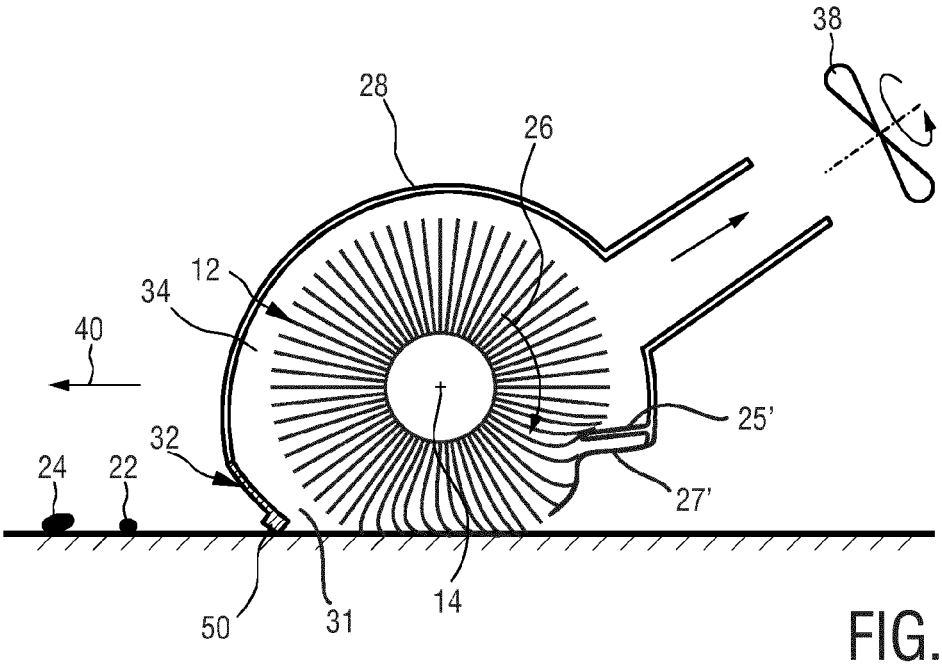
FIG. 5 shows a schematic cross-section of a third embodiment of the nozzle arrangement of the cleaning device according to the present invention.

FIG. 5 shows a third embodiment. The difference of this third embodiment is that the deflector 25' and the restriction element 27' are therein realized as separate parts. In contrast to the embodiments shown in FIGS. 1 to 4 the restriction element 27' is therein not directly attached to the deflector 25'. According to this embodiment the restriction element 27' is directly attached to the nozzle housing 28, separate from the deflector 25'. In order to guarantee the same properties as mentioned before, the restriction element 27' is, however, still arranged very close to the deflector 25'. In all embodiments the restriction element 27, 27' is, seen in rotation direction 26 of the brush 12, arranged behind the deflector 25, 25', such that the brush element 16 always contact the deflector 25, 25' before passing the restriction element 27, 27' and then leaving the nozzle housing 28 at its bottom side.

In the following further properties of the brush 12 and the rotational speed with which the brush 12 is driven shall be presented. The brush 12 preferably has a diameter which is in a range of 20 to 80 mm, and the driving unit may be capable of rotating the brush 12 at an angular velocity which is at least 3,000 revolutions per minute, preferably at an angular velocity around 6,000 rpm and above. A width of the brush 12, i.e. a dimension of the brush 12 in a direction in which the rotation axis 14 of the brush 12 is extending, may be in an order of 25 cm, for example.

On an exterior surface of a core element 52 of the brush 12, tufts 54 are provided. Each tuft 54 comprises hundreds of fiber elements, which are referred to as brush elements 16. For example, the brush elements 16 are made of polyester or nylon with a diameter in an order of about 10 micrometers, and with a Dtex value which is lower than 150 g per 10 km. A packing density of the brush elements 16 may be at least 30 tufts 54 per $cm^2$ on the exterior surface of the core element 52 of the brush 12.

The brush elements 16 may be arranged rather chaotically, i.e. not at fixed mutual distances. Furthermore, it shall be noted that an exterior surface 56 of the brush elements 16 may be uneven, which enhances the capability of the brush elements 16 to catch liquid droplets 24 and dirt particles 22. In particular, the brush elements 16 may be so-called microfibers, which do not have a smooth and more or less circular circumference, but which have a rugged and more or less star-shaped circumference with notches and grooves. The brush elements 16 do not need to be identical, but preferably the linear mass density of a majority of a total number of the brush elements 16 of the brush 12 meets the requirement of being lower than 150 g per 10 km, at least at tip portions 18.

By means of the rotating brush 12, in particular by means of the brush elements 16 of the rotating brush 12, dirt particles 22 and liquid 24 are picked up from the surface 20, and are transported to a collecting position inside the cleaning device 100. Due to the rotation of the brush 12, a moment occurs at which a first contact with the surface 20 is realized at a first position. The extent of contact is increased until the brush elements 16 are bent in such a way that the tip portions 18 of the brush elements 16 are in contact with the surface 20. The tip portions 18 as mentioned slide across the surface 20 and encounter dirt particles 22 and liquid 24 in the process, wherein an encounter may lead to a situation in which a quantity of liquid 24 and/or a dirt particles 22 are moved away from the surface 20 to be cleaned and are taken along by the brush elements 16 on the basis of adhesion forces.

In the process, the brush elements 16 may act more or less like a whip for catching and dragging particles 22, 24, which is force-closed and capable of holding on to a particle 22, 24 on the basis of a functioning which is comparable to the functioning of a band brake. Furthermore, the liquid 24 which is picked up may pull a bit of liquid with it, wherein a line of liquid is left in the air, which is moving away from the surface 20. The occurring accelerations at the tip portions 18 of the brush elements 16 cause the dirt particles 22 and liquid droplets 24 to be automatically released from the brush 12, when the brush elements loose contact from the floor 20 during their rotation. Since not all dirt particles 22 and liquid droplets 24 may be directly ingested by the vacuum aggregate 38, a small amount of dirt and liquid will be flung back onto the surface 20 in the area where the brush elements 16 loose the contact from the surface 20. However, this effect of re-spraying the surface 20 is overcome by the squeegee element 32 which collects this re-sprayed liquid and dirt by acting as kind of wiper, so that the remaining liquid 24 and dirt 22 may then be ingested due to the applied under-pressure. The liquid 24 and dirt 22 does therefore not leave the suction area 34 again without being ingested.

Due to the chosen technical parameters the brush elements 16 have a gentle scrubbing effect on the surface 20, which contributes to counteracting adhesion of liquid 24 and dirt particles 22 to the surface 20.

As the brush 12 rotates, the movement of the brush elements 16 over the surface 20 continues until a moment occurs at which contact is eventually lost. When there is no longer a situation of contact, the brush elements 16 are urged to assume an original, outstretched condition under the influence of centrifugal forces which are acting on the brush elements 16 as a result of the rotation of the brush 12. As the brush elements 16 are bent at the time that there is an urge to assume the outstretched condition again, an additional, outstretching acceleration is present at the tip portions 18 of the brush elements 16, wherein the brush elements 16 swish from the bent condition to the outstretched condition, wherein the movement of the brush elements 16 is comparable to a whip which is swished. The acceleration at the tip portions 18 at the time the brush elements 16 have almost assumed the outstretched condition again meets a requirement of being at least 3,000 $m/sec^2$.

Under the influence of the forces acting at the tip portions 18 of the brush elements 16 during the movement as described, the quantities of dirt particles 22 and liquid 24 are expelled from the brush elements 16, as these forces are considerably higher than the adhesion forces. Hence, the liquid 24 and the dirt particles 22 are forced to fly away in a direction which faces away from the surface 20. The most part of the liquid 24 and the dirt particles 22 is then ingested by the vacuum aggregate. By means of the squeegee element 32 and the under-pressure generated in the suction area 34, as explained above, it is ensured that also the remaining part of the liquid 24 and the dirt 22, that is sprayed back from the brush 12 to the surface 20, is collected and then also ingested.

Under the influence of the acceleration, the liquid 24 may be expelled in small droplets. This is advantageous for further separation processes such as performed by the vacuum fan aggregate 38, in particular the centrifugal fan of the vacuum aggregate 38, which serves as a rotatable air-dirt separator. It is noted that suction forces such as the forces exerted by the centrifugal fan do not play a role in the above-described process of picking up liquid and dirt by means of brush elements 16. However, these suction forces are necessary for picking up the dirt and liquid that has been collected by the squeegee.

Besides the functioning of each of the brush elements 16, as described in the foregoing, another effect which contributes to the process of picking up dirt particles 22 and liquid 24 may occur, namely a capillary effect between the brush elements 16. In this respect, the brush 12 with the brush elements 16 is comparable to a brush 12 which is dipped in a quantity of paint, wherein paint is absorbed by the brush 12 on the basis of capillary forces.

It appears from the foregoing that the brush 12 according to the present invention has the following properties:

- the soft tufts 54 with the flexible brush elements 16 will be stretched out by centrifugal forces during the contact-free part of a revolution of the brush 12;
- it is possible to have a perfect fit between the brush 12 and the surface 20 to be cleaned, since the soft tufts 54 will bend whenever they touch the surface 20, and straighten out whenever possible under the influence of centrifugal forces;

the brush 12 constantly cleans itself, due to sufficiently high acceleration forces, which ensures a constant cleaning result;

heat generation between the surface 20 and the brush 12 is minimal, because of a very low bending stiffness of the tufts 54;

a very even pick-up of liquid from the surface 20 and a very even overall cleaning result can be realized, even if creases or dents are present in the surface 20, on the basis of the fact that the liquid 24 is picked up by the tufts 54 and not by an airflow as in many conventional devices; and dirt 22 is removed from the surface 20 in a gentle yet effective way, by means of the tufts 54, wherein a most efficient use of energy can be realized on the basis of the low stiffness of the brush elements 16.

On the basis of the relatively low value of the linear mass density, it may be so that the brush elements 16 have very low bending stiffness, and, when packed in tufts 54, are not capable of remaining in their original shape. In conventional brushes, the brush elements spring back once released. However, the brush elements 16 having the very low bending stiffness as mentioned will not do that, since the elastic forces are so small that they cannot exceed internal friction forces which are present between the individual brush elements 16. Hence, the tufts 54 will remain crushed after deformation, and will only stretch out when the brush 12 is rotating.

In comparison with conventional devices comprising hard brushes (agitators) for contacting a surface to be cleaned, the brush 12 which is used according to the present invention is capable of realizing cleaning results which are significantly better, due to the working principle according to which brush elements 16 are used for picking up liquid 24 and dirt 22 and taking the liquid 24 and the dirt 22 away from the surface 20 to be cleaned, wherein the liquid 24 and the dirt 22 are flung away by the brush elements 16 before they contact the surface 20 again in a next round. The micro-fiber hairs that are used as brush elements 16 also have the advantage that the hairs serve as a flow restriction when passing the restriction element 27. The brush 12 therefore shows a very good sealing effect. Stiff hairs of an adjutator could instead not do so.

Figure 9:
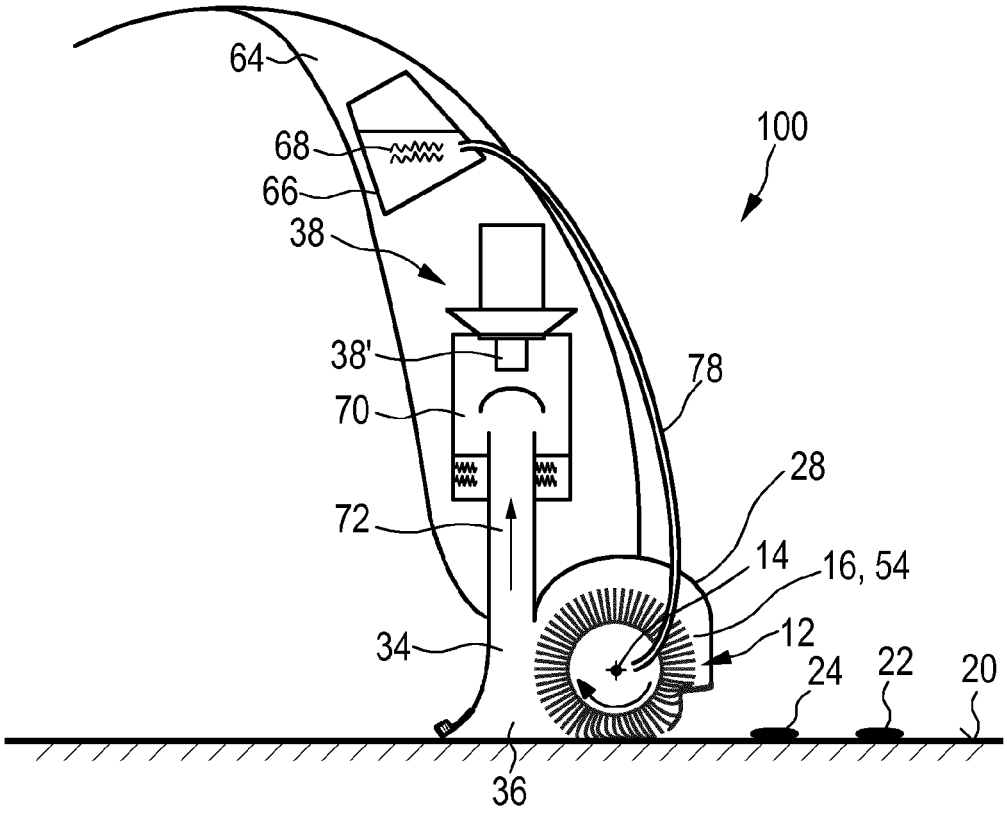
FIG. 9 shows a schematic cross-section of the cleaning device according to the present invention in its entirety.

FIG. 9 provides a view of the cleaning device 100 according to the present invention in its entirety. According to this schematic arrangement the cleaning device 100 comprises a nozzle housing 28 in which the brush 12 is rotatably mounted on the brush axis 14. A drive unit, which can be realized being a regular motor, such as e.g. an electro motor (not shown), is preferably connected to or even located on the brush axis 14 for the purpose of driving the brush 12 in rotation. It is noted that the motor may also be located at any other suitable position within the cleaning device 100.

In the nozzle housing 28, means such as wheels (not shown) are arranged for keeping the rotation axis 14 of the brush 12 at a predetermined distance from the surface 20 to be cleaned.

As already explained above, the squeegee element 32 is spaced apart from the brush 12 and attached to the bottom side 30 of the nozzle housing 28. It extends substantially parallel to the brush axis 14, thereby defining a suction area 34 within the nozzle housing 28 in between the squeegee element 32 and the brush 12, which suction area 34 has a suction inlet 36 which is located at the bottom side 30 of the nozzle housing 28 facing the surface 20 to be cleaned.

Besides the nozzle housing 28, the brush 12 and the squeegee element 32, the cleaning device 100 is preferably provided with the following components:

a handle 64 which allows for easy manipulation of the cleaning device 100 by a user;

a reservoir 66 for containing a cleansing liquid 68 such as water;

a debris collecting container 70 for receiving liquid 24 and dirt particles 22 picked up from the surface 20 to be cleaned;

a flow channel in the form of, for example, a hollow tube 72, connecting the debris collecting container 70 to the suction area 34, which suction area 34 constitutes the suction inlet 36 on the bottom side 30 of the nozzle 10. It has to be noted that, in the meaning of the present invention the flow channel including the hollow tube 72 may also be denoted as suction area 34 in which the above mentioned under-pressure is applied by the vacuum aggregate 38; and the vacuum fan aggregate 38 comprising a centrifugal fan 38', arranged at a side of the debris collecting chamber 70 which is opposite to the side where the tube 72 is arranged.

For sake of completeness, it is noted that within the scope of the present invention, other and/or additional constructional details are possible. For example, an element may be provided for deflecting the debris 22, 24 that is flung upwards, so that the debris 22, 24 first undergoes a deflection before it eventually reaches the debris collecting chamber 70. Also, the vacuum fan aggregate 38 may be arranged at another side of the debris collecting chamber 70 than the side which is opposite to the side where the tube 72 is arranged.

Figure 10:
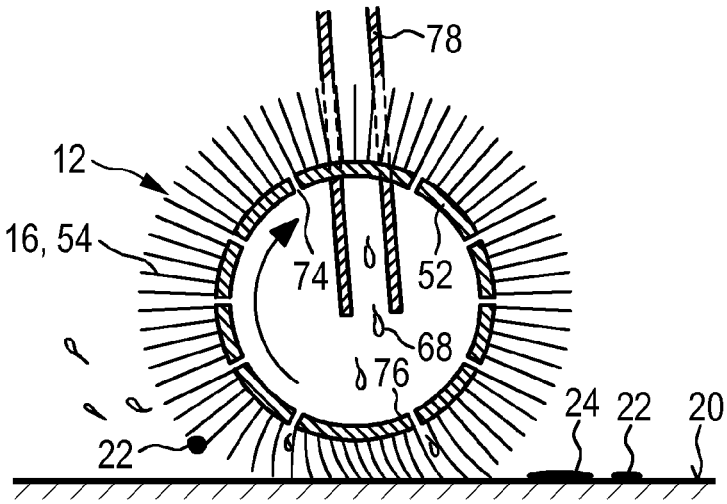
FIG. 10 shows a schematic cross-section of a further embodiment of a brush that may be used in the cleaning device according to the present invention.

According to an embodiment, which is shown in FIG. 10, the brush 12 comprises a core element 52. This core element 52 is in the form of a hollow tube provided with a number of channels 74 extending through a wall 76 of the core element 52. For the purpose of transporting cleansing fluid 68 from the reservoir 66 to the inside of the hollow core element 52 of the brush 12, e.g. a flexible tube 78 may be provided that leads into the inside of the core element 52.

According to this embodiment cleansing fluid 68 may be supplied to the hollow core element 52, wherein, during the rotation of the brush 12, the liquid 68 leaves the hollow core element 52 via the channels 74, and wets the brush elements 16. In this way the liquid 68 also drizzles or falls on the surface 20 to be cleaned. Thus, the surface 20 to be cleaned becomes wet with the cleansing liquid 68. This especially enhances the adherence of the dirt particles 22 to the brush elements 16 and, therefore improves the ability to remove stains from the surface 20 to be cleaned.

According to the present invention, the rate at which the liquid 68 is supplied to the hollow core element 52 can be quite low, wherein a maximum rate can be 6 ml per minute per cm of the width of the brush 12, for example.

However, it is to be noted that the feature of actively supplying water 68 to the surface 20 to be cleaned using hollow channels 74 within the brush 12 is not a necessary feature. Alternatively, a cleansing liquid could be supplied by spraying the brush 12 from outside or by simply immersing the brush 12 in cleansing water before the use. Instead of using an intentionally chosen liquid, it is also possible to use a liquid that has been already spilled, i.e. a liquid that needs to be removed from the surface 20 to be cleaned.

The pick-up of the cleansing water 68 from the floor is, as already mentioned above, either done by the squeegee element 32 which collects the water by acting as a kind of wiper transporting liquid to the suction area 34 where it is ingested due to the under-pressure generated by the vacuum aggregate 38, or the water is directly picked-up from the floor by the brush 12. In comparison with conventional devices comprising hard brushes that are not able to pick-up water, the brush 12 used according to the present invention is capable of picking-up water. The realized cleaning results are thus significantly better.

The technical parameters regarding the brush 12, the brush elements 16 and the drive unit result from experiments which have been performed in the context of the present invention.

In the following, one of the experiments and the results of the experiment will be described. The tested brushes were equipped with different types of fiber materials used for the brush elements 16, including relatively thick fibers and relatively thin fibers. Furthermore, the packing density as well as the Dtex values have been varied. The particulars of the various brushes are given in the following table.

| | packing density (# tufts/cm$^2$) | fibers per tuft | Dtex value (g/10 km) | fiber material | fiber length (mm) | fiber appearance |
|---|---|---|---|---|---|---|
| brush 1 | 160 | 9 | 113.5 | nylon | 10 | springy, straight |
| brush 2 | 25 | 35 | 31.0 | nylon | 11 | fairly hard, curled |
| brush 3 | 40 | 90 | 16.1 | — | 11 | very soft, twined |
| brush 4 | 50 | 798 | 0.8 | polyester | 11 | very soft, twined |

The experiment includes rotating the brush under similar conditions and assessing cleaning results, wear, and power to the surface 20 subjected to treatment with the brush 12. This provides an indication of heat generation on the surface 20. The outcome of the experiment is reflected in the following table, wherein a mark 5 is used for indicating the best results, and lower marks are used for indicating poorer results.

| | stain removal | water pick-up | wear | power to the surface |
|---|---|---|---|---|
| Brush 1 | 5 | 3 | 3 | 3 |
| Brush 2 | 5 | 3 | 1 | 4 |
| Brush 3 | 5 | 4 | 4 | 5 |
| Brush 4 | 5 | 5 | 5 | 5 |

Among other things, the experiment proves that it is possible to have brush elements 16 with a linear mass density in a range of 100 to 150 g per 10 km, and to obtain useful cleaning results, although it appears that the water pick-up, the wear behavior and the power consumption are not so good. It is concluded that an appropriate limit value for the linear mass density is 150 g per 10 km. However, it is clear that with a much lower linear mass density, the cleaning results and all other results are very good. Therefore, it is preferred to apply lower limit values, such as 125 g per 10 km, 50 g per 10 km, 20 g per 10 km, or even 5 g per 10 km. With values in the latter order, it is ensured that cleaning results are excellent, water pick-up is optimal, wear is minimal, and power consumption and heat generation on the surface 20 are sufficiently low.

It is noted that the minimum value of 3,000 m/sec$^2$ in respect of the acceleration which is prevailing at tips 18 of the brush elements 16 during some time per revolution of the brush 12, in particular some time during a dirt release period, in which there is no contact between the brush elements 16 and the surface 20, is supported by results of experiments which have been performed in the context of the present invention.

In the following, one of the experiments and the results of the experiment will be described. The following conditions are applicable to the experiment:

1) A brush 12 having a diameter of 46 mm, a width of approximately 12 cm, and polyester brush elements 16 with a linear mass density of about 0.8 g per 10 km, arranged in tufts 54 of about 800 brush elements 16, with approximately 50 tufts 54 per cm$^2$, is mounted on a motor shaft.

2) The weight of the assembly of the brush 12 and the motor is determined

3) The power supply of the motor is connected to a timer for stopping the motor after a period of operation of 1 second or a period of operation of 4 seconds.

4) The brush 12 is immersed in water, so that the brush 12 is completely saturated with the water. It is noted that the brush 12 which is used appears to be capable of absorbing a total weight of water of approximately 70 g.

5) The brush 12 is rotated at an angular velocity of 1,950 revolutions per minute, and is stopped after 1 second or 4 seconds.

6) The weight of the assembly of the brush 12 and the motor is determined, and the difference with respect to the dry weight, which is determined under step 2), is calculated.

7) Steps 4) to 6) are repeated for other values of the angular velocity, in particular the values as indicated in the following table, which further contains values of the weight of the water still present in the brush 12 at the stops after 1 second and 4 seconds, and values of the associated centrifugal acceleration, which can be calculated according to the following equation:

$$a=(2*\pi*f)^2*R$$

in which:
a=centrifugal acceleration (m/s$^2$)
f=brush frequency (Hz)
R=radius of the brush 12 (m)

| angular velocity (rpm) | weight of water present after 1 s (g) | weight of water present after 4 s (g) | centrifugal acceleration (m/s$^2$) |
|---|---|---|---|
| 1,950 | 8.27 | 7.50 | 959 |
| 2,480 | 5.70 | 4.57 | 1,551 |
| 3,080 | 3.70 | 3.11 | 2,393 |
| 4,280 | 2.52 | 1.97 | 4,620 |
| 5,540 | 1.95 | 1.35 | 7,741 |
| 6,830 | 1.72 | 1.14 | 11,765 |
| 7,910 | 1.48 | 1.00 | 15,780 |
| 9,140 | 1.34 | 0.94 | 21,069 |

Figure 11:
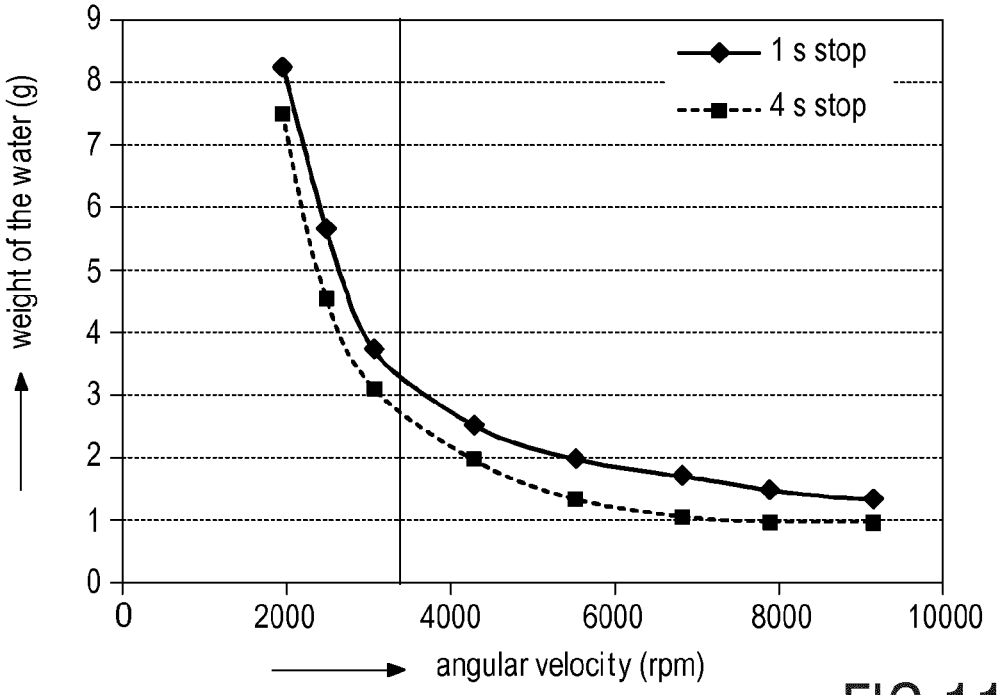
FIG. 11 shows a graph which serves for illustrating a relation between an angular velocity of a brush and a self-cleaning capacity of the brush.
Figure 12:
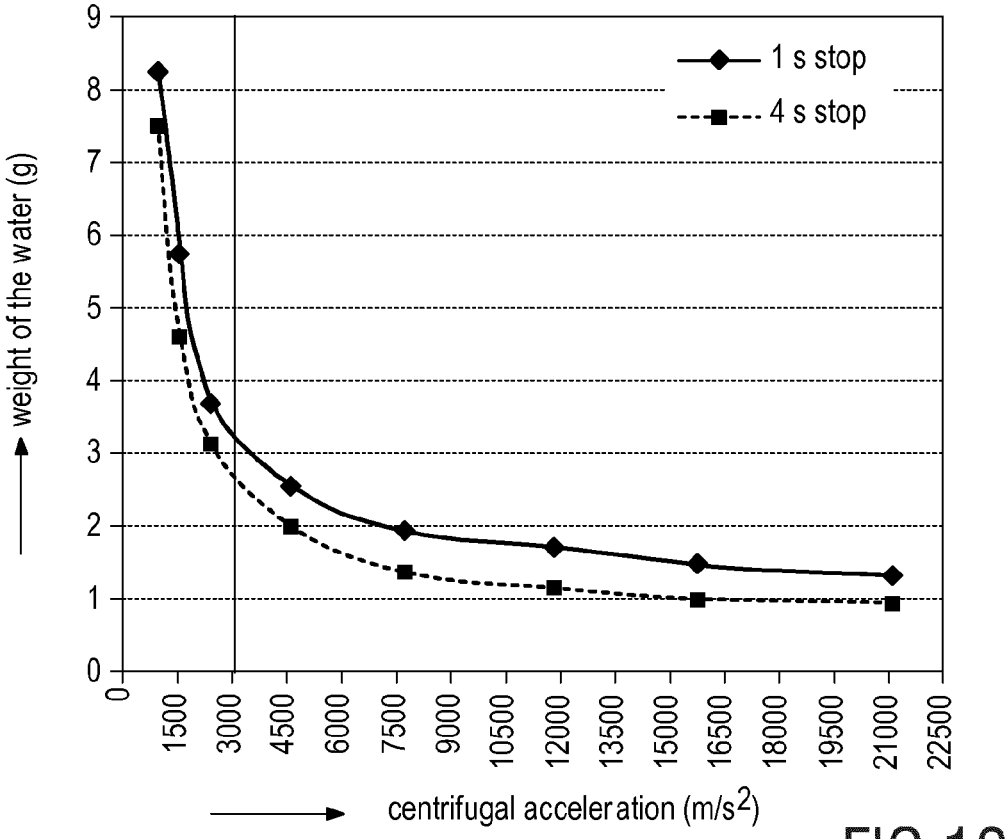
FIG. 12 shows a graph which serves for illustrating a relation between a centrifugal acceleration of a brush and a self-cleaning capacity of the brush.

The relation which is found between the angular velocity and the weight of the water for the two different stops is depicted in the graph of FIG. 11, and the relation which is found between the centrifugal acceleration and the weight of the water for the two different stops is depicted in the graph of FIG. 12, wherein the weight of the water is indicated at the vertical axis of each of the graphs. It appears from the graph of FIG. 9 that the release of water by the brush 12 strongly decreases, when the angular velocity is lower than about 4,000 rpm. Also, it seems to be rather stable at angular velocities which are higher than 6,000 rpm to 7,000 rpm.

A transition in the release of water by the brush 12 can be found at an angular velocity of 3,500 rpm, which corresponds to a centrifugal acceleration of 3,090 m/s$^2$. For sake of illustration of this fact, the graphs of FIGS. 11 and 12 contain a vertical line indicating the values of 3,500 rpm and 3,090 m/s$^2$, respectively.

On the basis of the results of the experiment as explained in the foregoing, it may be concluded that a value of 3,000 $m/s^2$ in respect of an acceleration at tips 18 of the brush elements 16 during a contact-free period is a realistic minimum value as far as the self-cleaning capacity of brush elements 16 which meet the requirement of having a linear mass density which is lower than 150 g per 10 km, at least at tip portions 18, is concerned. A proper performance of the self-cleaning function is important for obtaining good cleaning results, as has already been explained in the foregoing.

For sake of completeness, it is noted that in the cleaning device 100 according to the present invention, the centrifugal acceleration may be lower than 3,000 $m/s^2$. The reason is that the acceleration which occurs at tips 18 of the brush elements 16 when the brush elements 16 are straightened out can be expected to be higher than the normal centrifugal acceleration. The experiment shows that a minimum value of 3,000 $m/s^2$ is valid in respect of an acceleration, which is the normal, centrifugal acceleration in the case of the experiment, and which can be the higher acceleration which is caused by the specific behavior of the brush elements 16 when the dirt pick-up period has passed and there is room for straightening out in an actual cleaning device 100 according to the present invention, which leaves a possibility for the normal, centrifugal acceleration during the other periods of the rotation (e.g. the dirt pick-up period) to be lower.

Even though a single brush is, according to the present invention, preferred, it is clear that also further brushes may be used without leaving the scope of the present invention.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

For sake of clarity, it is noted that a fully outstretched condition of the brush elements 16 is a condition in which the brush elements 16 are fully extending in a radial direction with respect to a rotation axis 14 of the brush 12, wherein there is no bent tip portion in the brush elements 16. This condition can be realized when the brush 12 is rotating at a normal operative speed, which is a speed at which the acceleration of 3,000 $m/sec^2$ at the tips 18 of the brush elements 16 can be realized. It is possible for only a portion of the brush elements 16 of a brush 12 to be in the fully outstretched condition, while another portion is not, due to obstructions which are encountered by the brush elements 16. Normally, the diameter D of the brush 12 is determined with all of the brush elements 16 in the fully outstretched condition.

The tip portions 18 of the brush elements 16 are outer portions of the brush elements 16 as seen in the radial direction, i.e. portions which are the most remote from the rotation axis 14. In particular, the tip portions 18 are the portions which are used for picking up dirt particles 22 and liquid, and which are made to slide along the surface 20 to be cleaned. In case the brush 12 is indented with respect to the surface 20, a length of the tip portion is approximately the same as the indentation.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A nozzle arrangement for a cleaning device, the nozzle arrangement comprising:

a nozzle housing, a brush rotatable about a brush axis, the brush being provided with flexible brush elements having tip portions for contacting the surface to be cleaned and picking up dirt and/or liquid particles from the surface during the rotation of the brush, wherein the brush is at least partly surrounded by the nozzle housing and protrudes at least partly from a bottom side of the nozzle housing, a drive unit for rotating the brush, a squeegee element which is spaced apart from the brush and attached to the bottom side of the nozzle housing on a first side of the brush where the brush elements enter the nozzle housing during the rotation of the brush, wherein the squeegee element is configured for wiping dirt and/or liquid particles across or off the surface to be cleaned during a movement of the cleaning device a deflector for contacting the brush and deflecting the brush elements during the rotation of the brush, and a restriction element for at least partly restricting air from getting sucked into the nozzle housing at a second side of the brush where the brush elements leave the nozzle housing, wherein the restriction element is, seen in a rotation direction of the brush, arranged behind the deflector, such that the brush elements, during the rotation of the brush, contact the deflector before passing the restriction element and then leaving the nozzle housing at the bottom side, characterized in that the restriction element comprises a mechanically flexible element that is, due to its flexibility, configured to follow an outer surface of the brush and to contact the tip portions during the rotation of the brush.

2. The nozzle arrangement as claimed in claim 1, wherein the mechanically flexible element is made of a sheet of fabric material, rubber or plastic.

3. The nozzle arrangement as claimed in claim 1, wherein the deflector is made of a mechanically flexible material.

4. The nozzle arrangement as claimed in claim 1, wherein the restriction element comprises a plurality of slits that are arranged parallel to each other and perpendicular to the brush axis.

5. The nozzle arrangement as claimed in claim 1, wherein the restriction element and the deflector are arranged on the second side of the brush where the brush elements leave the nozzle housing during the rotation of the brush, wherein the second side is opposite to the first side with respect to the brush axis.

6. The nozzle arrangement as claimed in claim 1, wherein the squeegee element comprises a switching unit for switching the squeegee element to a closed position, in which the squeegee element is configured to push or wipe dirt and/or liquid particles across or off the surface to be cleaned, when the cleaning device is moved on the surface in a forward direction, in which the squeegee element is, seen in the direction of movement of the cleaning device, located behind the brush, and for switching the squeegee element to an open position, in which dirt and/or liquid particles from the surface to be cleaned can enter the suction area through an opening between the squeegee element and the surface, when the cleaning device is moved on the surface in a backward direction, in which the squeegee element is, seen in the direction of movement of the cleaning device, located in front of the brush.

7. The nozzle arrangement as claimed in claim 1, wherein a linear mass density of a plurality of the brush elements is, at least at the tip portions, lower than 150 g per 10 km, preferably lower than 20 g per 10 km.

8. The nozzle arrangement as claimed in claim 1, wherein the drive unit is adapted to realize a centrifugal acceleration at the tip portions of the brush elements which is, in particular during a dirt release period when the brush elements are free from contact to the surface during rotation of the brush, at least 3,000 $m/s^2$, more preferably at least 7,000 $m/s^2$, and most preferably 12,000 $m/s^2$.

9. The nozzle arrangement as claimed in claim 1, wherein the drive unit is adapted to realize an angular velocity of the brush which is in a range of 3,000 to 15,000 revolutions per minute, more preferably in a range of 5,000 to 8,000 revolutions per minute, during operation of the device.

10. The nozzle arrangement as claimed in claim 1, wherein the brush has a diameter which is in a range of 10 to 100 mm, more preferably in a range of 20 to 80 mm, most preferably in a range of 35 to 50 mm, when the brush elements are in a fully outstretched condition during the rotation of the brush, and wherein the length of the brush elements is in a range of 1 to 20 mm, preferably in a range of 8 to 12 mm, when the brush elements are in a fully outstretched condition during the rotation of the brush.

11. The nozzle arrangement as claimed in claim 1, wherein a packing density of the brush elements is at least 30 tufts of brush elements per $cm^2$, and wherein a number of brush elements per tuft is at least 500.

12. A cleaning device for cleaning a surface, the cleaning device comprising:

the nozzle arrangement as claimed in claim 1; and a vacuum aggregate for generating an under-pressure in a suction area between the nozzle housing and the brush.

13. The cleaning device as claimed in claim 12, wherein the vacuum aggregate is configured to generate an under-pressure in a range of 3 to 70 mbar, preferably in a range of 4 to 50 mbar, most preferably in a range of 5 to 30 mbar.

* * * * *